US010401772B2

(12) United States Patent
Ueno

(10) Patent No.: US 10,401,772 B2
(45) Date of Patent: Sep. 3, 2019

(54) DECOLORING APPARATUS

(71) Applicant: TOSHIBA TEC KABUSHIKI KAISHA, Shinagawa-ku, Tokyo (JP)

(72) Inventor: Toshiyuki Ueno, Shimizu Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/007,001

(22) Filed: Jun. 13, 2018

(65) Prior Publication Data

US 2019/0049885 A1 Feb. 14, 2019

(30) Foreign Application Priority Data

Aug. 10, 2017 (JP) ..... 2017-155372

(51) Int. Cl.

| | |
|---|---|
| ***G03G 15/00*** | (2006.01) |
| ***G03G 21/00*** | (2006.01) |
| ***B41M 7/00*** | (2006.01) |
| ***G03G 15/01*** | (2006.01) |
| *G03G 15/20* | (2006.01) |

(52) U.S. Cl.

CPC ..... *G03G 15/5062* (2013.01); *B41M 7/0009* (2013.01); *G03G 15/0142* (2013.01); *G03G 21/00* (2013.01); *G03G 15/205* (2013.01); *G03G 2215/0196* (2013.01)

(58) Field of Classification Search

CPC ..... G03G 15/5062; G03G 15/0142; G03G 2215/0196; B41M 7/0009

See application file for complete search history.

(56) References Cited

U.S. PATENT DOCUMENTS

| | | | | |
|---|---|---|---|---|
| 8,928,710 | B2 | 1/2015 | Umetsu | |
| 2008/0129775 | A1* | 6/2008 | Hayakawa | B41J 2/1652 347/23 |
| 2012/0025454 | A1* | 2/2012 | Iguchi | B65H 29/60 271/225 |
| 2015/0022850 | A1* | 1/2015 | Morizumi | G06K 15/1867 358/1.15 |
| 2015/0253709 | A1* | 9/2015 | Fukaya | G03G 21/20 399/82 |

(Continued)

FOREIGN PATENT DOCUMENTS

JP 5257241 B1 8/2013

*Primary Examiner* — Francis C Gray
(74) *Attorney, Agent, or Firm* — Foley & Lardner LLP

(57) ABSTRACT

A decoloring apparatus includes a decoloring assembly, a driver configured to drive the decoloring section, and a storage configured to store first setting information, as setting information when there is no next job, and second setting information, as setting information when there is a next job; and a controller. The controller is configured to perform control to drive the decoloring assembly based on conveyance speed and set temperature corresponding to a predetermined, coverage rate of the image receiving medium in the first setting information stored in the storage if there is no next job, or perform control to drive the decoloring assembly based on the conveyance speed and the set temperature corresponding to a predetermined coverage rate of the image receiving medium in the second setting information stored in the storage if there is a next job.

5 Claims, 8 Drawing Sheets

(56) References Cited

U.S. PATENT DOCUMENTS

| | | | | |
|---|---|---|---|---|
| 2016/0088192 | A1* | 3/2016 | Mizuno | H04N 1/60 358/1.9 |
| 2016/0114610 | A1* | 4/2016 | Iguchi | B41J 2/4753 347/179 |
| 2016/0221375 | A1* | 8/2016 | Katakura | B41M 5/305 |
| 2018/0088515 | A1* | 3/2018 | Iguchi | B65H 7/00 |
| 2018/0181035 | A1* | 6/2018 | Hashimoto | G03G 15/205 |
| 2018/0203398 | A1* | 7/2018 | Ishida | G03G 15/6576 |
| 2019/0049884 | A1* | 2/2019 | Ogasawara | G03G 15/5008 |

* cited by examiner

DECOLORING APPARATUS

CROSS-REFERENCE TO RELATED APPLICATION

This application is based upon and claims the benefit of priority from Japanese Patent Application No. 2017-155372, filed Aug. 10, 2017, the entire contents of which are incorporated herein by reference:

FIELD

Embodiments described herein relate generally to a decoloring apparatus capable of reducing power consumption.

BACKGROUND

A decoloring apparatus or a MFP (Multi-Function Peripheral) having a decoloring function, which is capable of decoloring a developed color of a toner by applying heat, is known. These apparatuses need to prevent the color of the toner froth remaining after decoloring in any coverage rates. Therefore, it is necessary to determine various performances such as a set temperature, of a heat source targeted at a paper having highest coverage rate and a processing speed of the paper (for example, refer to Japanese unexamined Patent Application Publication No. 2016-212432).

DETAILED DESCRIPTION

In accordance with some embodiments, a decoloring apparatus comprises a decoloring section (assembly) configured to heat an image receiving medium on which an image is formed by a decolorable color material at a predetermined set temperature; a driving section (driver) configured to drive the decoloring section at a predetermined conveyance speed; a storage section (storage) configured to store first setting information, as setting information when there is no next job, in which a set temperature of the decoloring section for each of plural coverage rates of the image receiving medium and a conveyance speed of the driving section are associated with each other, and second setting information, as setting information when there is a next job, in which a set temperature of the decoloring section for each of plural coverage rates of the image receiving medium and a conveyance speed of the driving section are associated with each other; and a controller configured to perform control to drive the decoloring section based on the conveyance speed and the set temperature corresponding to a predetermined coverage rate of the image receiving medium in the first setting information stored in the storage section if there is no next job, or perform control to drive the decoloring section based on the conveyance speed and the set temperature corresponding to a predetermined coverage rate of the image receiving medium in the second setting information stored in the storage section if there is a next job.

Embodiments will be described below with reference to the accompanying drawings. In the embodiments, a MFP is described as an example of an apparatus having a function of decoloring an image.

Figure 1:
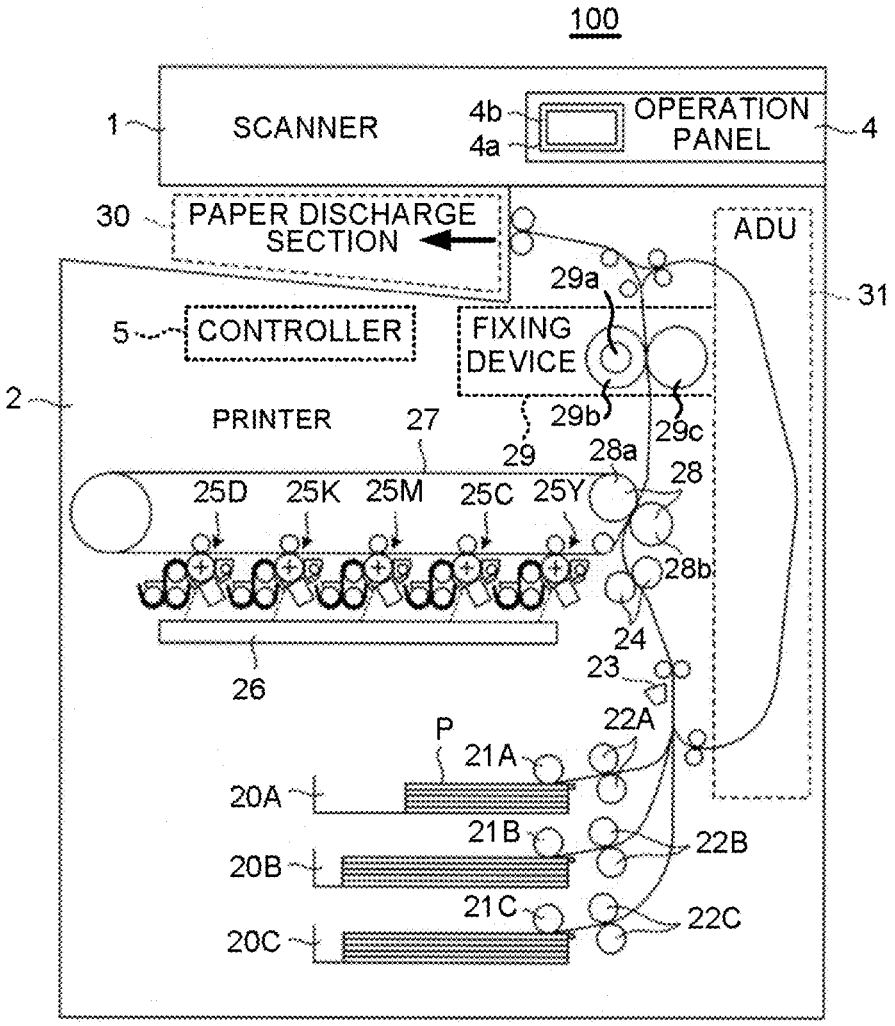
FIG. 1 is a cross-sectional view schematically illustrating an example of a MFP according to some embodiments.

FIG. 1 is a cross-sectional view schematically illustrating a configuration example of a MFP 100 according to the embodiment. As shown in FIG. 1, the MFP 100 has a scanner 1, a printer 2, an operation panel 4, and a controller 5.

For example, the scanner 1, installed at an upper side of a main body of the MFP 100, reads an image on a document and converts it to image data. The scanner 1 having a well-known configuration is includes, for example, a CCD line sensor that converts an image on a reading surface of a document to image data. The scanner 1 may scan a document placed on a document table glass (not shown) or read an image on a document conveyed by an ADF (Auto Document Feeder). The scanner 1 is controlled by the controller 5.

The printer 2 forms an image on a paper P used as an image receiving medium. In the present embodiment, the printer 2 is an image forming section of an electrophotographic system. The printer 2 uses plural types (for example, five types, i.e., yellow (Y), cyan (C), magenta (M), black (K), and decolorable (D)) of toners to form a color image. The decolorable toner (D) is decolorable by heating at a temperature higher than a fixing temperature. The color of the decolorable toner (D) is, for example, dark blue or black. A well-known configuration for generating an image by the printer 2 is described later in detail.

The decolorable toner used in the some embodiments is, for example, formed by containing a color material in binder resin. The decolorable color material includes a color developing compound, a developer, and a decoloring agent. For example, leuco dyes are provided as the color developing compound. Phenols are provided as the developer. A substance that is compatible with the color developing compound if heated and has no affinity for the developer may be provided as the decoloring agent. The decolorable color material develops color due to an interaction between the color developing compound and the developer, and is decolored due to cutting of the interaction between the color developing compound and the developer by heating, to a decoloring temperature or higher. The "decoloring" in embodiments means making an image formed by a color (including not only chromatic color but also achromatic colors such as white and black) different from a color of a base of the sheet visually invisible or difficult to see visually. The "make it visually invisible" includes a case of changing a color of the image formed with the color different from the color of the base of the sheet to a color the same as or similar to the color of the base of the sheet in addition to a mode in which the image formed with the color different from the color of the base of the sheet is colorless (transparent).

In the example arrangement shown in FIG. 1, the printer 2 has paper feed cassettes 20 (20A, 20B, 20C) as a paper feed section. For example, each of the paper feed cassettes 20A, 20B, 20C can be inserted into and removed from the lower part of the main body of the MFP 100. The paper feed cassettes 20A, 20B and 20C accommodate papers P of set types (for example, size, paper quality), respectively. The paper feed cassettes corresponding to the sizes of the papers may be set respectively after the papers P of different sizes are accommodated in the paper feed cassettes 20A, 20B and 20C. Each of the paper feed cassettes 20A, 20B and 20C is provided with a paper feed section sensor. The paper feed section sensor detects a capacity of storage of the papers accommodated in the paper feed tray 22. The paper feed section sensor may be, for example, an infrared sensor. A mechanical sensor such as a sensor using well-known microswitches may also be used. The paper feed section sensor sends a detection result to the controller 5 described later. The printer 2 may have a known manual feed tray (not shown) as another paper feed section. In some embodiments, a paper with a high coverage rate is placed in the paper feed cassette 20A, a paper with a middle coverage rate is placed in the paper feed cassette 20B, and a paper with a low coverage rate is placed in the paper feed cassette 20C. Here, the coverage rate is a rate of a printed area to an area of one paper. For example, the coverage rate may be expressed as (printed area of a paper)/(area of the paper) [%].

The setting information relating to the paper P accommodated in each of the paper feed cassettes 20A, 20B and 20C is stored in a non-volatile memory. The printer 2 selects the paper feed cassette accommodating the paper P to be used in a printing process based on the setting information. The printer 2 prints an image on the paper P fed from the selected paper feed cassette. If the printer 2 has a manual feed tray, the size of the paper P set in the manual feed tray which is input through the operation panel 4 should be stored in the non-volatile memory described above. This non-volatile memory is a HDD 55 described later.

In the following description, since the paper is conveyed from the paper feed section 20 to the paper discharge section 30, the paper feed section 20 side is defined as an upstream side in a paper conveyance direction, and the paper discharge section 30 side is defined as a downstream side in the paper conveyance direction.

A conveyance roller 22 shown in FIG. 1 is arranged along a conveyance path of the paper in the printer 2 to convey the paper P. The conveyance roller 22 is driven by a motor (not shown). The conveyance roller 22 conveys the paper P supplied from the paper feed cassette 20A, 20B, or 20C by a corresponding pickup roller 21A, 21B, or 21C to a registration roller 24 arranged on the upstream side of a transfer section 28 described later. The registration roller 24 conveys the paper P to a transfer position at a timing of transferring the image from an intermediate transfer belt 27, described later, onto the paper P.

The details of image formation are described below. An image forming section 25, an exposure section 26, the intermediate transfer belt 27, and the transfer section 28 shown in FIG. 1 function as a well-known image forming module for forming an image. The image forming section 25 forms an image to be transferred onto the paper. In the example arrangement for generating the color image shown in FIG. 1, as will be described in detail later, the image forming section 25Y forms, using yellow toner, an image corresponding to yellow obtained by performing color separation on a document image. The image forming section 25M similarly forms a corresponding image with magenta toner. The image forming section 25C forms a corresponding image with cyan toner. The image forming section 25K forms a corresponding image with black toner. Then, each of the image forming sections 25Y, 25M, 25C, and 25K transfers the toner images of the respective colors onto the intermediate transfer belt 27 in an overlapped manner. On the other hand, the image forming section 25D is used when the paper is reused, and forms a decolorable document image with a decolorable toner. As described above, the color of the decolorable toner is dark blue or black. Accordingly, the image formed by the image forming section 25D is a monochrome (monochromatic) image. Each of the image forming sections 25Y, 25M, 25C, 25K and 25D includes well-known configurations, for example, a photoconductive drum, an electrostatic charger, a developing section containing a toner, a charge removing section and the like (only shown in FIG. 1). The image forming section 25D is used only when the paper is reused, but since the configuration and the operation thereof are the same as those of other image forming sections except that the used toners are different, the description thereof is made at the same time.

The image formation by the electrophotographic system is described in detail below. Each of the image forming sections 25Y, 25M, 25C, 25K, and 25D has well-known sensors such as a potential sensor and a density sensor (not shown). The potential sensor detects a surface potential of the well-known photoconductive drum of each image forming section. At each of the image forming sections 25Y, 25M, 25C, 25K and 25D, the well-known electrostatic charger charges the surface of the photoconductive drum before the photoconductive drum is exposed by the exposure section 26 described below. The controller 5 can change charging conditions by the electrostatic charger. The potential sensor detects a surface potential of the photoconductive drum whose surface is charged by the electrostatic charger. The density sensor detects a density of a toner image transferred onto the intermediate transfer belt 27 described later. The density sensor may detect the density of a toner image formed on the photoconductive drum.

The exposure section 26 forms an electrostatic latent image of the document image acquired by the scanner 1 with laser light on the charged photoconductive drum of each of the image forming sections 25Y, 25M, 25C, 25K and 25D as described above. The electrostatic latent image formed on each photoconductive drum is developed with toner of each color. Specifically, the exposure section 26 irradiates each photoconductive drum with laser light corresponding to each image forming section which is controlled in response to the image data via an optical system such as a polygon mirror. The exposure section 26 controls the power of the laser light in response to the control signal from the controller 5. The exposure section 26 also controls a modulation amount of a pulse width for controlling the emission of the laser light in response to the control signal from the controller 5.

As described above, each of the image forming sections 25Y, 25M, 25C, 25K, and 25D develops the electrostatic latent image formed on the photoconductive drum thereof with toner of each color by the developing section. Each of the image forming sections 25Y, 25M, 25C, 25K and 25D forms a toner image as a visible image on the photoconductive drum thereof. The intermediate transfer belt 27 is an intermediate transfer body. In the case of forming a color image with a non-decolorable toner, each of the image forming sections 25Y, 25M, 25C, and 25K transfers the toner image formed on the photoconductive drum thereof onto the intermediate transfer belt 27 (primary transfer). Specifically, each of the image forming sections 25Y, 25M, 25C, and 25K applies a transfer bias to the toner image at a primary transfer position (for example, a position where the photoconductive drum and the transfer belt contact with each other). Each of the image forming sections 25Y, 25M, 25C and 25K controls the transfer bias with a transfer current. The toner images on the photoconductive drums are respectively transferred onto the intermediate transfer belt 27 by the transfer biases at the respective primary transfer positions. The controller 5 controls the transfer current used for the primary transfer process by each image forming section. On the other hand, if the paper is reused, i.e., when a monochrome image is formed with the decolorable toner, a toner image as a visible image is formed on the photoconductive drum by the image forming section 25D. The toner image is transferred onto the intermediate transfer belt 27 as described above.

The transfer section 28 has a support roller 28*a* and a secondary transfer roller 28*b* provided along the conveyance path of the paper P, and transfers the toner image on the intermediate transfer belt 27 onto the paper P at a secondary transfer position. The secondary transfer position is a position where the support roller 28*a* and the secondary transfer roller 28*b* face each other across the intermediate transfer belt 27. The transfer section 28 applies a transfer bias controlled by the transfer current to the belt 27 at the secondary transfer position. The transfer section 28 transfers the toner image on the intermediate transfer belt 27 onto the paper P by the transfer bias. The controller 5 controls the transfer current used for a secondary transfer process.

A fixing device 29 arranged on the downstream side of the transfer section 28 described above has a function of fixing the toner image on the paper P. For example, in the embodiment, the fixing device 29 fixes the toner image on the paper P by the heat and pressure applied to the paper P.

Figure 2:
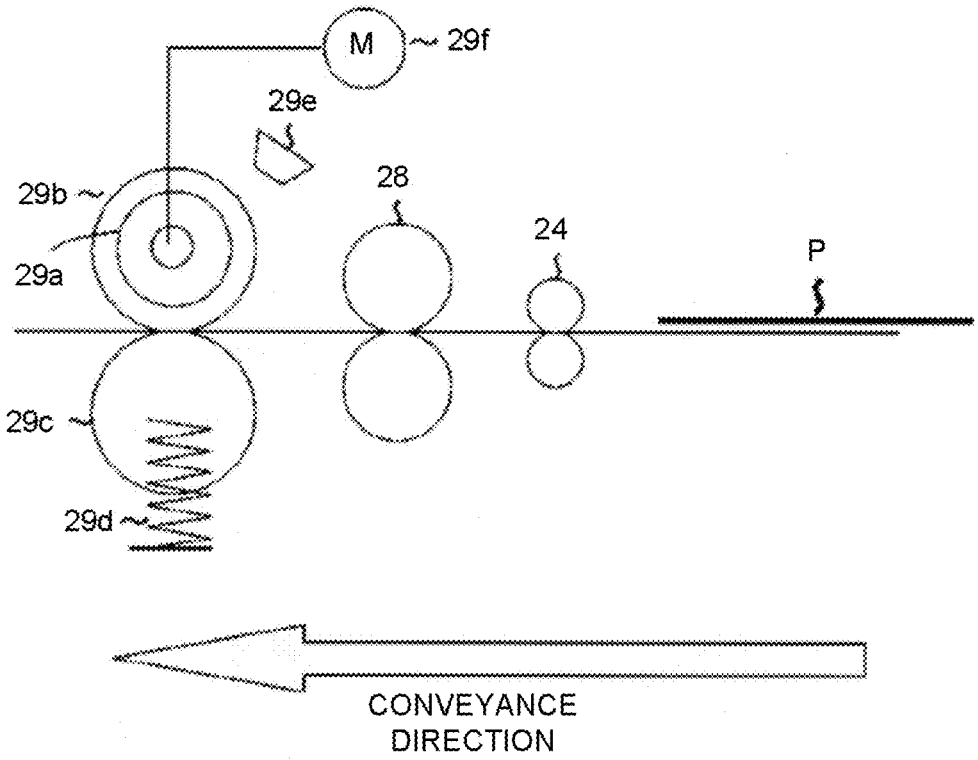
FIG. 2 is a schematic view of a fixing device according to some embodiments.

In the configuration examples shown in FIG. 1 and FIG. 2, the fixing device 29 includes a heat roller (heating section) 29*b* having a heating source 29*a* therein, and a pressure roller (pressure section) 29*c* in contact with the paper P in a pressurized state by a pressure mechanism 29*d*. The heating source 29*a* may be a well-known heater whose temperature is controllable. For example, the heating source 29*a* may be a heater lamp such as a halogen lamp or a heater of an induction heating (IH) system. The heating source 29*a* may be composed of a plurality of heaters. The fixing device 29 further has a temperature sensor 29*e* for measuring the temperature of the heat roller 29*b*. The temperature sensor 29*e* transmits the temperature of the heat roller 29*b* to the controller 5 described later. The controller 5 controls the heating source 29*a* based on the temperature sent from the temperature sensor 29*e* to control the temperature of the heat roller 29*b*. The pressure mechanism 29*d* presses the pressure roller 29*c* towards the heat roller 29*b*. The pressure mechanism 29*d* is made of an elastic member or the like. If the pressure roller 29*c* is pressed against the heat roller 29*b* by the pressure mechanism 29*d*, the pressure roller 29*c* and the heat roller 29*b* are separated from each other, and a gap is formed therebetween. The heat roller 29*b* is rotationally driven by a driving section 29*f*. When pressed towards the heat roller 29*b*, the pressure roller 29*c* is rotationally driven following the heat roller 29*b*. As shown in FIG. 2, the registration roller 24, the transfer section 28 and the fixing device 29 are provided towards the downstream side in the conveyance direction.

In a case of performing a decoloring process of decoloring an image formed on the paper P, the controller 5 performs control in such a manner that the temperature of the fixing device 29 reaches the predetermined decoloring temperature.

In the fixing process, the paper P accommodated in the paper feed cassette 20A is picked up towards a conveyance path by the pickup roller 21A and then the paper P is conveyed to the transfer section 28. The transfer section 28 transfers the toner image onto the paper P as described above. The fixing device 29 pressurizes the paper P onto which the toner image is transferred with the pressure roller 29*c* while heating the paper P at a fixing temperature with the heating roller 29*b* whose temperature reaches a predetermined fixing temperature. In this way, the fixing device 29 fixes the toner image on the paper P. In the decoloring process, the paper P accommodated in the paper feed cassette 20B is picked up to the conveyance path by the pickup roller 21B and then conveyed to the fixing device 29. At this time, the transfer by the transfer section 28 is not performed. The fixing device 29 pressurizes the paper P onto which an image is formed with the decolorable toner with the pressure roller 29*c* while heating the paper P at a decoloring temperature with the heating roller 29*b* whose temperature reaches a predetermined decoloring temperature.

If the fixing process or the decoloring process is terminated, the paper P subjected to the fixing process is conveyed to either a paper discharge section 30 or an ADU (Automatic Duplex Unit) 31 in response to a process request from a user by a well-known branching mechanism (not shown) arranged on the downstream side of the fixing device 29. If the paper P subjected to the fixing process by the fixing device 29 is discharged, the paper P is discharged to the paper discharge section 30. If an image is also formed on a back surface of the paper P subjected to the fixing process by the fixing device 29, the paper P is temporarily conveyed to the paper discharge section 30 side, and then is switched back to be conveyed to the ADU 31. In this case, the ADU 31 again supplies the paper P reversed by switchback to the upstream side of the registration roller 24 again as shown in FIG. 1.

The operation panel 4 is a user interface. The operation panel 4 is usually arranged on the upper front side of the main body of the MFP 100, and has various well-known input buttons and a display section 4*a* having a touch panel 4*b*. The controller 5 controls the content displayed on the display section 4*a* of the operation panel 4. Furthermore, the operation panel 4 outputs information input through the touch panel 4*b* of the display section 4*a* or an input button to the controller 8. The operator operates the operation panel 4 to select either a printing mode or a decoloring mode. As described above, the printing mode is a mode in which an image is formed with a non-decolorable toner or a decolorable toner on the paper P set in the paper feed cassette 20A and then the fixing process is performed on the paper P. The decoloring mode is a mode in which the decoloring process on an image formed on the paper P set in the paper feed cassette 20B is performed. In other words, the decoloring mode is a mode of decoloring the image formed on the paper using the paper feed section 20, the conveyance section 22, and the fixing device 29 without using the image forming section 25, the exposure section 26, the intermediate transfer belt 27, and the transfer section 28 of the printer 2. Information relating to each process, such as information necessary for the printing including the number of printed papers and density input at the time of the printing mode, information including the number of papers to be decolored input at the time of the decoloring mode and the like, is stored in a predetermined area of a RAM 54 described later as process information (the operation panel 4 is equivalent to an input section).

Figure 3:
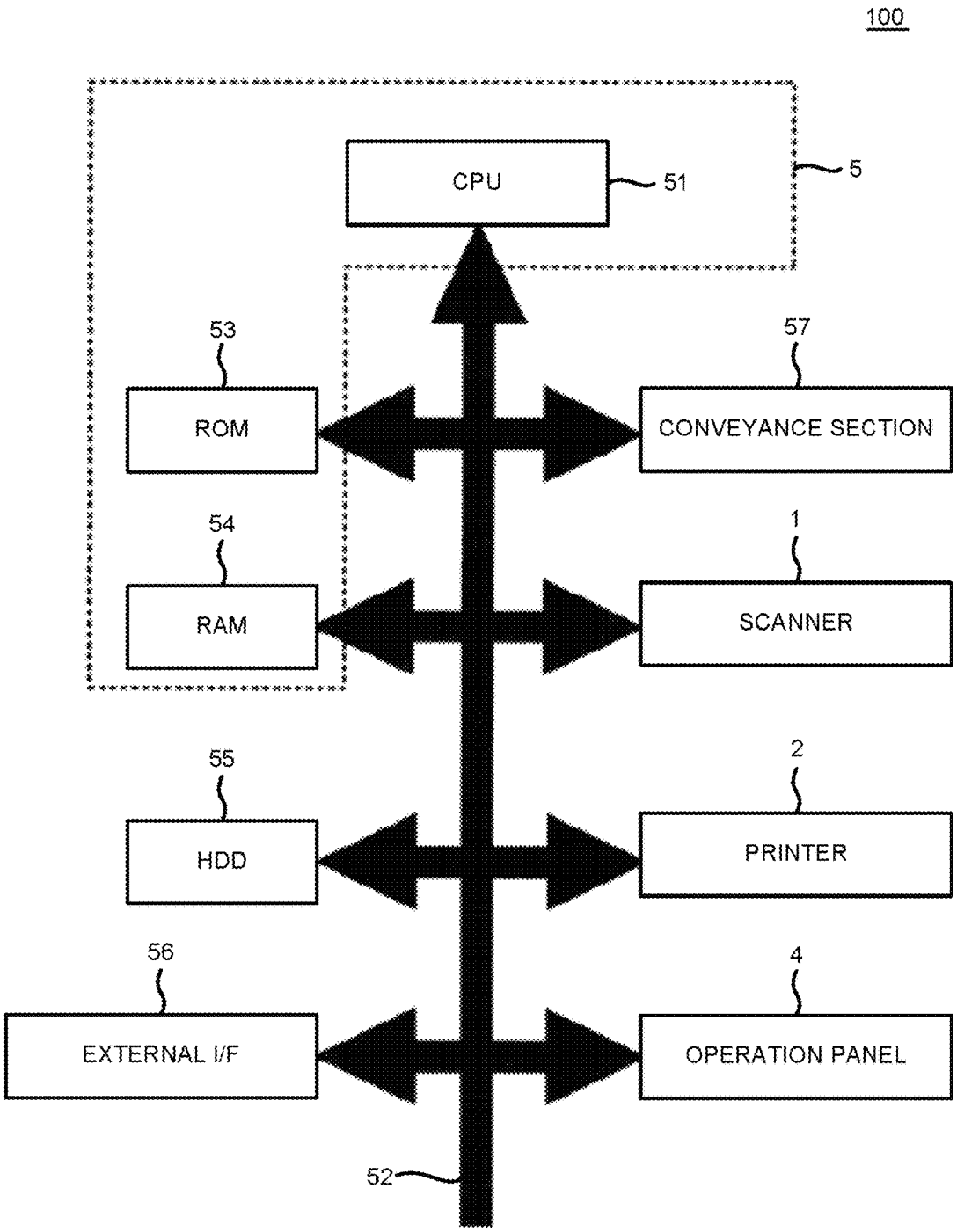
FIG. 3 is a block diagram of the MFP according to some embodiments.

Next, the configuration of the control system of the MFP 100 is described. FIG. 3 is a block diagram of the MFP 100 according to the embodiment. A CPU (Central Processing Unit) 51, a ROM (Read Only Memory) 53, the RAM (Random Access Memory) 54, a HDD (Hard Disk Drive) 55, an external I/F (Interface) 56, a conveyance section 57, the scanner 1, the printer 2, and the operation panel 4 are connected with each other via a system bus 52. The CPU 51, the ROM 53, and the RAM 54 constitute the controller 5.

In the ROM 53, programs to be executed by the CPU 51 and threshold values are stored in advance:

In the RAM 54, various memory areas, such as an area used for copying or decompressing programs executed by the CPU 51 and a work area which is an operation area for data process by executing a program, are dynamically formed. The RAM 54 has an image storage area for storing image information to be printed. An image is formed based on the image information stored in the image storage area, and then is primarily transferred onto the intermediate transfer belt 27. The image information stored in the image storage area may be received from an external device via the external I/F 56, or acquired from an image on the paper P via the scanner 1.

Figure 5:
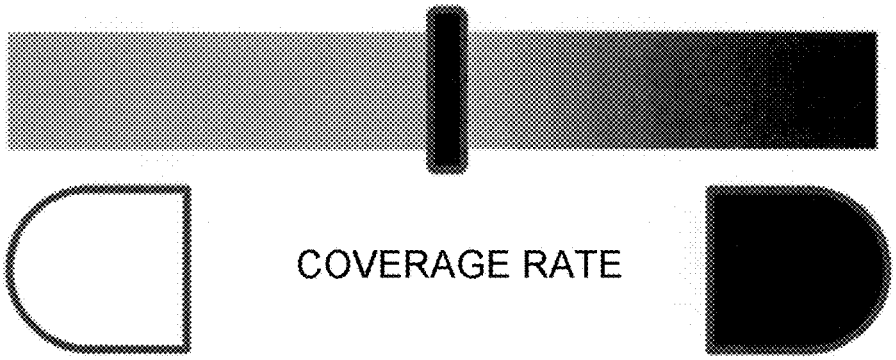
FIG. 5 is a diagram illustrating an example of a coverage rate setting displayed on an operation panel according to some embodiments.

Furthermore, the RAM 54 stores a processing information file (refer to Table 1) as a job queue for storing processing information input from a user I/F (shown in FIG. 5) of the operation panel 4. The processing information is input automatically or manually in order to execute each process (job). As shown in Table 1, the processing information file includes a number area, a cassette area, a coverage rate area, and the like. The information in each area is associated with each job. The printing information stored in the processing information file includes the density, a paper size, and the like, but only a part thereof is exemplified in Table 1. In the following, the process and the processing information when the MFP 100 executes the decoloring job are described. The number area is used for storing the order of jobs. As the order of the jobs in the number area, numbers 1, 2, 3 are determined as the result of receiving the job. The cassette area is used for stoking a cassette in which the paper to be subjected to the decoloring process is placed. The cassette area is used for storing one cassette, a plurality of cassettes, or a manual feed tray. The coverage rate area is used for storing a coverage rate of the paper to be decolored. The coverage rate is associated with a case in which the job is the decoloring job. The cassette area and the coverage rate area are areas where information is inputted by an operator operating the operation panel 4. The controller 5 reads contents in these areas to execute the decoloring process.

TABLE 1

| Number | Cassette | Coverage rate |
|---|---|---|
| 1 | 20A | High |
| 2 | 20B | Middle |
| | 20C | Low |
| 3 | Manual feed tray | Low |

Then, the controller 5 refers to the number area of the processing information file to confirm the presence or absence of a next job, and to determine whether to operate the MFP 100 in a standard mode or in a high speed mode. In the standard mode, the target temperature of the heat roller 29*b* is changed for each coverage rate, and the conveyance section 57 is controlled at a constant conveyance speed. In the high speed mode, the target temperature of the heat roller 29*b* is kept constant, and the conveyance section 57 is controlled by changing the conveyance speed for each coverage rate.

In the HUD 55, an OS (Operating System) for operating the MFP 100 is installed. As described above, information indicating which type of paper is accommodated in each of the paper feed cassettes 20A, 20B and 20C is stored in a predetermined area of the HDD 55. Furthermore, the HDD 55 stores a setting file shown in Table 2. As shown in Table 2, the setting file includes a coverage rate area, a decoloring setting temperature area, and a conveyance speed area. The coverage rate area is used for storing the magnitude of the coverage rate of the paper printed with the decolorable toner (refer to FIG. 4).

The controller 5 performs a process corresponding to the coverage rate. The decoloring temperature setting area is used for storing a decoloring setting temperature according to the coverage rate. The conveyance speed area is used for storing the conveyance speed according to the coverage rate. In the embodiment, if the coverage rate is "high", the decoloring setting temperature is set to 130 degrees centigrade; if the coverage rate is "middle", the decoloring setting temperature is set to 120 degrees centigrade; and if the coverage rate is "low", the decoloring setting temperature is set to 110 degrees centigrade. In any case, the conveyance speed is set to a first conveyance speed $V_1$.

TABLE 2

| Coverage rate | Decoloring setting temperature (° C.) | Conveyance speed |
|---|---|---|
| High | 130 | $V_1$ |
| Middle | 120 | $V_1$ |
| Low | 110 | $V_1$ |

The HDD 55 stores a setting file shown in Table 3. As shown in Table 3, the setting file includes a cassette area, a coverage rate area, a standard mode area, and a high speed mode area. The cassette area is used for storing the cassette in which the paper to be decolorized is placed for each coverage rate. In the coverage rate area, the magnitude of the coverage rate of the paper printed with the decolorable toner is shown in plural stages (refer to FIG. 4). The controller 5 performs a process corresponding to the coverage rate. The standard mode area is used for storing the decoloring setting temperature and the conveyance speed in response to the coverage rate when there is no next job. The relationship of the magnitudes of the first conveyance speed $V_1$, a second conveyance speed $V_2$ and a third conveyance speed $V_3$ recorded in Table 3 is $V_1<V_2<V_3$. In the embodiment, when there is no next job, the lower the coverage rate is, the lower the decoloring setting temperature becomes, while the conveyance speed is kept constant. The high speed mode area is used for storing the decoloring setting temperature and the conveyance speed in response to the coverage rate when the next job is on standby. In the embodiment, at the standby time of the next job, the lower the coverage rate is, the higher the conveyance speed becomes, while the decoloring setting temperature is kept constant (130 degrees centigrade).

TABLE 3

| | | Standard mode | | High speed mode | |
|---|---|---|---|---|---|
| Cassette | Coverage rate | Decoloring setting temperature (° C.) | Conveyance speed | Decoloring setting temperature (° C.) | Conveyance speed |
| 20A | High | 130 | $V_1$ | 130 | $V_1$ |
| 20B | Middle | 120 | $V_1$ | 130 | $V_2$ |
| 20C | Low | 110 | $V_1$ | 130 | $V_3$ |

In the standard mode, the conveyance speed of the paper is constant regardless of the decoloring setting temperature. As shown in Table 2, in the embodiment, the conveyance speed in the standard mode is set to $V_1$. On the other hand, the decoloring temperature is set at plural stages, including 130 degrees centigrade when the coverage rate is "high", 120 degrees centigrade when the coverage rate is "middle", and 110 degrees centigrade when the coverage rate is "low". The high speed mode is a mode for changing the conveyance speed for each coverage rate. In the high speed mode, the target temperature of the heat roller 29*b* is 130 degrees centigrade. As shown in Table 2, in the embodiment, 130 degrees centigrade is set as a target temperature as the decoloring setting temperature in the high speed mode. On the other hand, the conveyance speed is set at plural stages, including the first conveyance speed $V_1$ when the coverage rate is "high", the second conveyance speed $V_2$ when the coverage rate is "middle", and the third conveyance speed $V_3$ when the coverage rate is "low". The controller 5 reads the contents in each area to control the decoloring process.

Returning again to FIG. 3, the external I/F 56 is an interface for communicating with an external device such as a client terminal (PC), for example. The external I/F 56 receives print data in response to a printing request from the external device. The external I/F 56 is used for performing data communication with the external device, for example, the external I/F 56 may be a device (USB memory or the like) locally connected to an external device, or a network interface for communicating via a network (the external I/F 56 may function as the input section).

The conveyance section 57 includes a plurality of motors and rollers for conveying the paper P, such as conveyance rollers, the registration roller 24, the driving section 29*f* and the like in the MFP 100. The motor of the conveyance section 57 is controlled by the controller 5 to change a rotation speed of respective rollers such as the heat roller 29*b*, the registration roller 24 and the like. Each roller can individually change stop and drive, speed, etc. as necessary.

Figure 7:
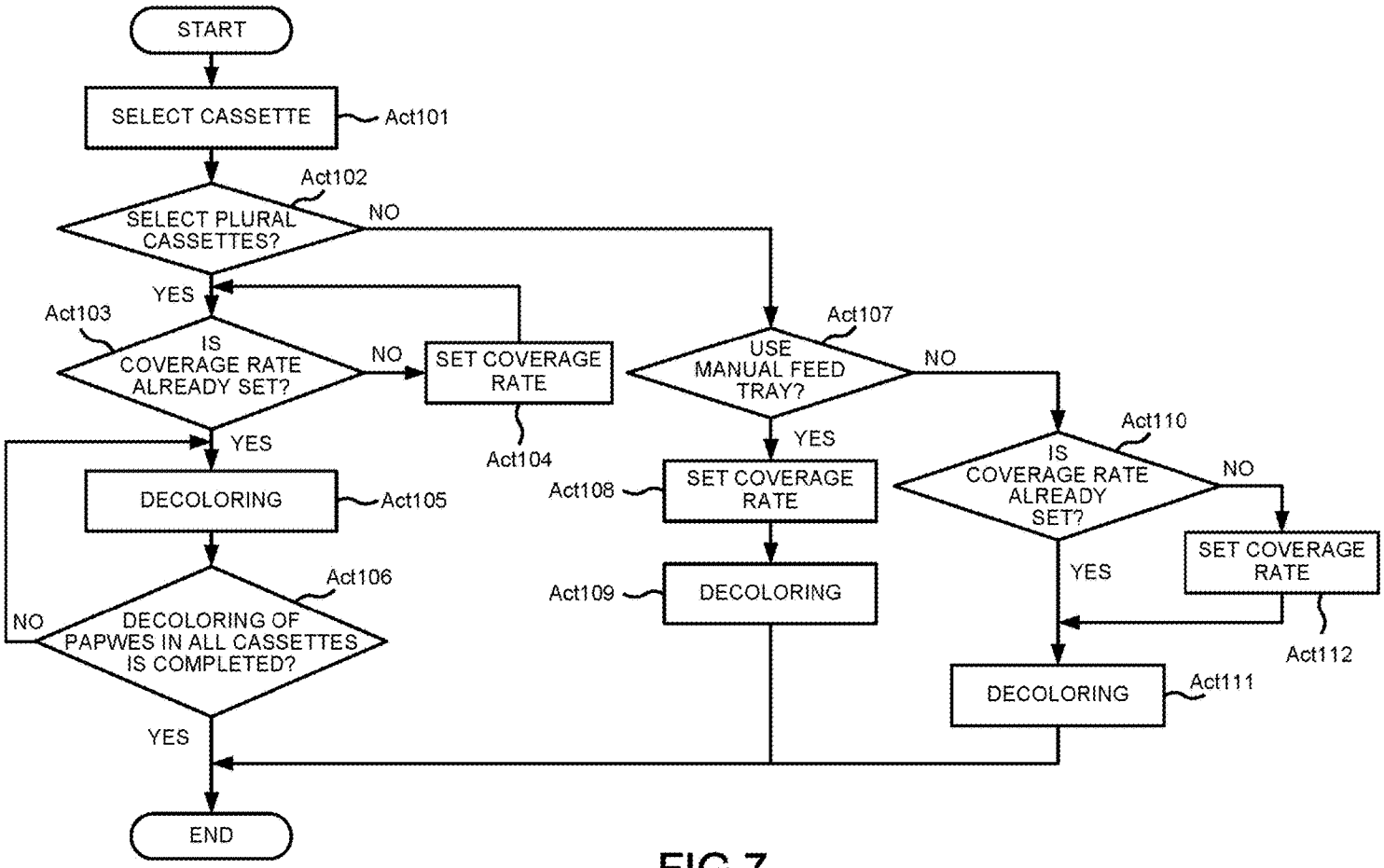
FIG. 7 is a flowchart depicting a decoloring job according to some embodiments.
Figure 8:
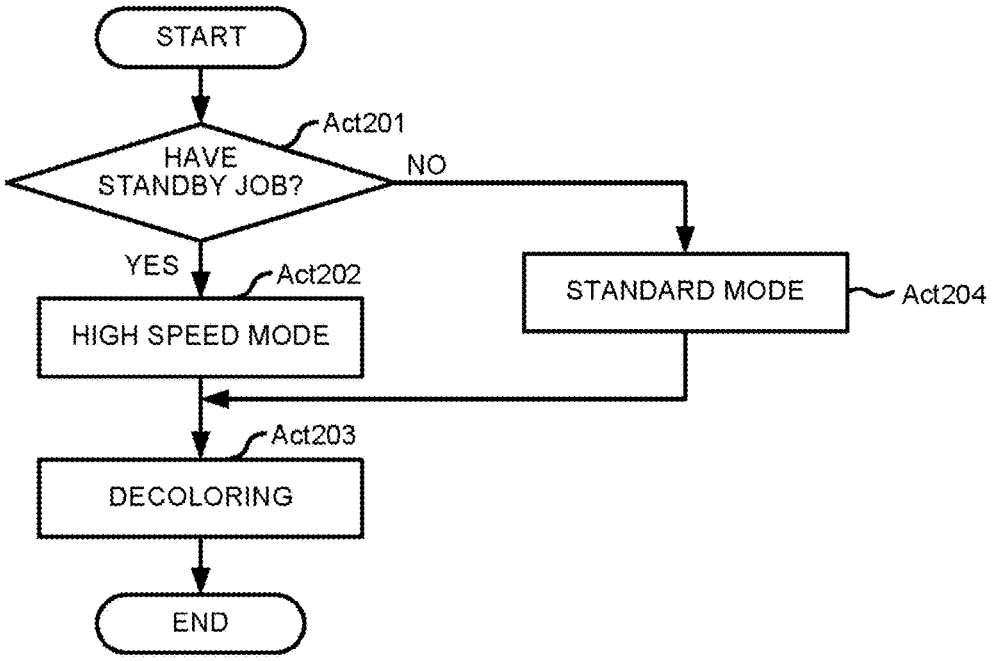
FIG. 8 is a flowchart depicting the decoloring job according to some embodiments.
Figure 9:
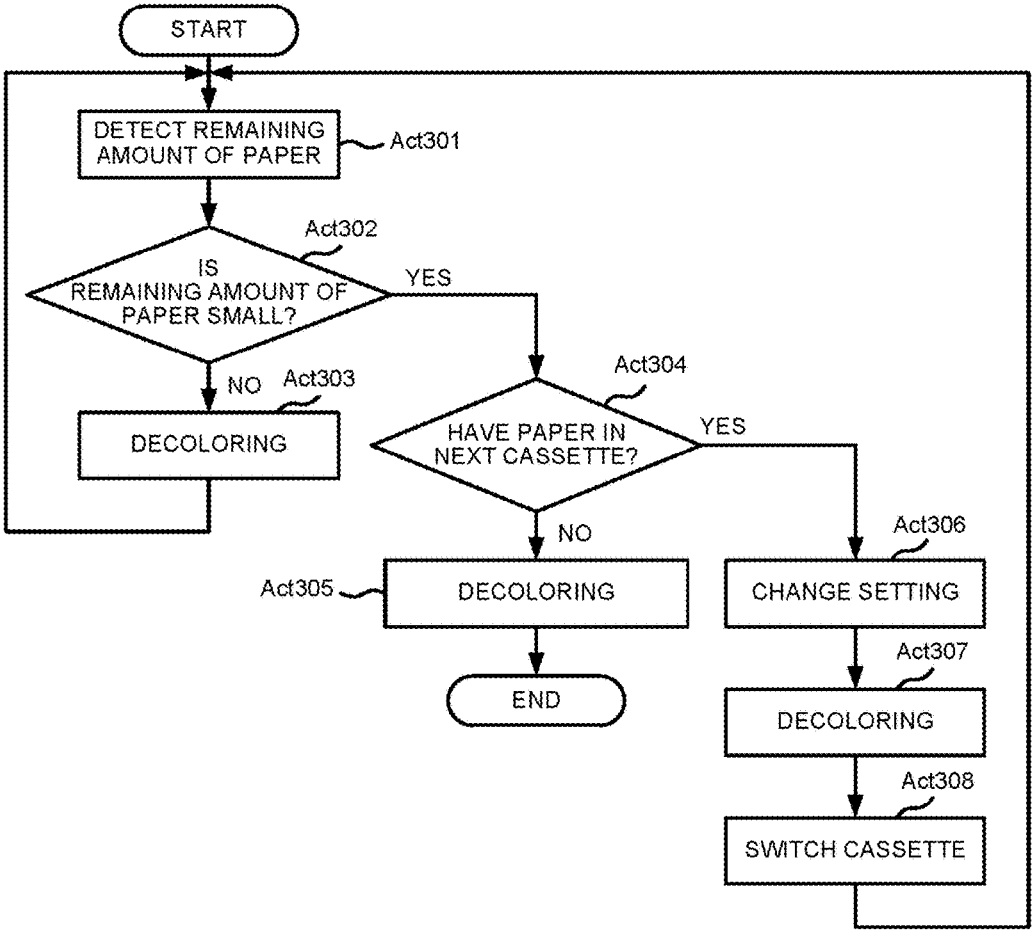
FIG. 9 is a flowchart depicting the decoloring job according to some embodiments.

The configurations of the scanner 1, the printer 2 and the operation panel 4 are described above, and thus the description thereof is omitted. In the MFP 100 having the above configuration, a decoloring job shown in FIG. 7 to FIG. 9 is executed based on a preset program.

In the MFP 100 according to some embodiments, the types of the cassettes are made different according to job setting by the operator or by placing papers with different coverage rates in respective cassettes. This changes the set temperature of the heat source and the conveyance speed setting for each decoloring job. According to some embodiments, it is possible to select an optimum temperature setting of the heat source for decoloring of a small amount of papers, and the decoloring is started from a cassette with low coverage rate for decoloring of a high number of papers. As a result, the heat of the heat source can be efficiently applied to the paper, and power consumption and warm-up time can be reduced.

Figure 4:
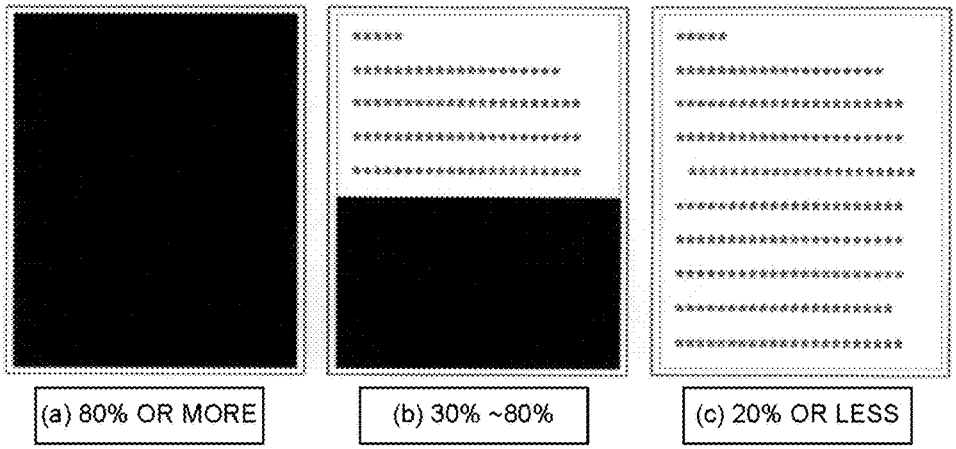
FIG. 4 is a diagram illustrating an example of a paper on which an image is printed with a decolorable toner according to some embodiments.

As shown in FIG. 4, the papers printed with the decolorable toner have a difference in the coverage rate. FIG. 4(*a*) shows a picture or a solid paper etc., which is an example of the coverage rate "high". FIG. 4(*b*) shows a document with characters and pictures, which is an example of the coverage rate "middle". FIG. 4(*c*) is a paper mainly containing characters, which is an example of the coverage rate "low". Conventionally, these are operated at the same temperature setting of the heat source and the same conveyance speed setting, but it is a waste of power consumption to decolor the papers with different coverage rates at the same temperature setting. In order to improve this, for example, if a small number of the papers are decolored, by arranging the user I/F shown in FIG. 5 with which the operator can set the coverage rate on the operation panel 4, it is possible to set optimally the temperature of the heat source and the conveyance speed for the paper to be decolored.

Figure 6:
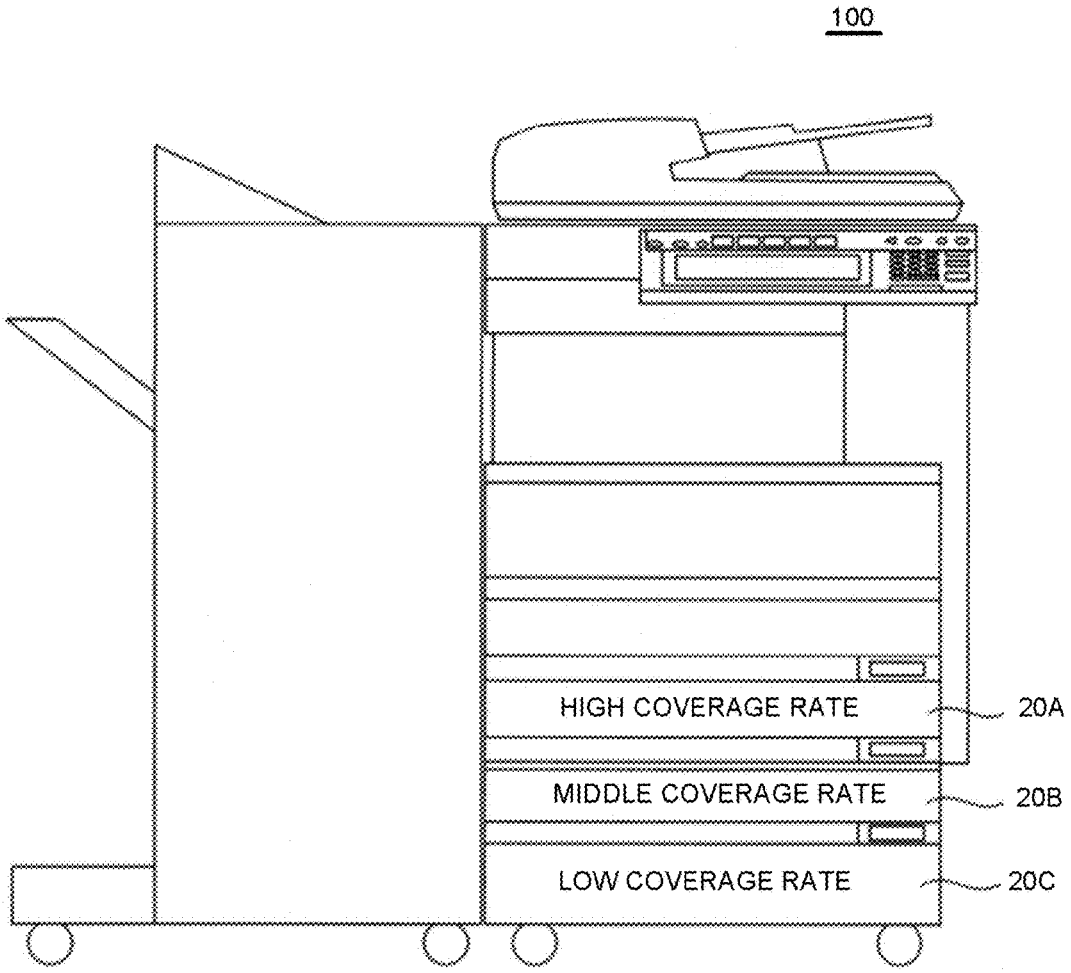
FIG. 6 is a diagram illustrating a setting of the coverage rate for each cassette according to some embodiments.

If a large number of the papers are decolored, for example, as shown in FIG. 6, the setting of the coverage rate can be performed for each cassette. Specifically, the user places the paper having the high coverage rate in the cassette 20A, places the paper having the middle coverage rate in the cassette 20B, and places the paper having the low coverage rate in the cassette 20C. The controller 5 sets the optimum temperature of the heat source and conveyance speed for each cassette. As a result, the set temperature of the heat source and the conveyance speed setting are optimum for each cassette, leading to reduction in waste of electric power at the time of decoloring and improvement of the speed in the paper decoloring process. Of course, it is possible to respond to the setting in the operation panel 4, and a delicate additional adjustment is also possible.

FIG. 7 is a flowchart depicting the decoloring process according to some embodiments. In this flow, the decoloring process is described on the presumption that there is no standby job which is a job to be executed. The controller 5 receives an input of selection of the paper feed cassette from the operation panel 4 and stores the selected cassette in the cassette area of the processing information file in the RAM 54 (ACT 101).

The controller 5 confirms whether there is an input of selecting a plurality of cassettes in the cassette area of the processing information file in the RAM 54 (ACT 102). If a plurality of cassettes is selected (Yes in ACT 102), the controller 5 determines whether the coverage rate for each cassette is already set in the coverage rate area of the processing information file in the RAM 54 (ACT 103). If the coverage rate for each cassette is not set yet (No in ACT 103), the controller 5 displays a message indicating that no coverage rate is set and a screen for setting the coverage rate for each cassette (the same is also applied in following Acts 108 and 112). The operator sets the coverage rate for each cassette with the user I/F (shown in FIG. 5) of the operation panel 4. The controller 5 stores the coverage rate setting in the processing information file in the RAM 54.

If the coverage rate for each cassette is already set (Yes in ACT 103), the controller 5 refers to the processing information file in the RAM 54 to execute decoloring started from the paper in a cassette with the lowest coverage rate among the selected cassettes (ACT 105). At this time, the controller 5 executes the decoloring according to the setting of the decoloring temperature and the conveyance speed corresponding to the coverage rate in the setting file of the HDD 55. For example, if the operator selects the cassette 20B and the cassette 20C, the controller 5 executes the decoloring started from the cassette 20C having the low coverage rate. In this case, the decoloring setting temperature 110 degrees centigrade and the first conveyance speed $V_1$, which are conditions when the coverage rate is low, are read from the setting file, and the decoloring is performed by performing control so as to heat the heat roller 29*b* up to 110 degrees centigrade and set the conveyance speed of the conveyance section 57 to the first conveyance speed $V_1$. If the decoloring of papers in all the cassettes is not completed (No in ACT 106), the decoloring is executed according to the setting of a setting file 80 in the RAM 54, and if the decoloring of papers in all the cassettes is completed (Yes in ACT 106), the decoloring is terminated.

If a plurality of cassettes is not selected (No in ACT 102), the controller 5 confirms the input of selecting the manual feed tray in the cassette area of the processing information file in the RAM 54 (ACT 107). If the manual feed tray is selected (Yes in ACT 107), the operator inputs the setting of the coverage rate from the user I/F (shown in FIG. 5) of the operation panel 4, and the controller 5 stores the setting of the coverage rate in the coverage rate area of the processing information file in the RAM 54 (ACT 108). The controller 5 refers to the setting of the coverage rate in the processing information file in the RAM 54 and conveys the paper to the decoloring section in accordance with the setting of the decoloring temperature and the conveyance speed corresponding to the coverage rate in the setting file of the HDD 55 (ACT 109).

If the manual feed tray is not selected (No in ACT 107), the controller 5 determines whether or not the coverage rate in the coverage rate area of the processing information file in the RAM 54 is already set (ACT 110). If the coverage rate of the cassette is set (Yes in ACT 110), the controller 5 refers to the setting of the coverage rate in the processing information file in the RAM 54 to execute the decoloring in accordance with the setting of the decoloring temperature and the conveyance speed corresponding to the coverage rate in the setting file in the HDD 55 (ACT 111). If the coverage rate of the cassette is not set (No in ACT 110), the operator inputs the value of the coverage rate through the operation panel 4, and the controller 5 associates the cassette with the coverage rate in the processing information file in the RAM 54 to store the coverage rate (ACT 112).

For example, if there are many papers to be subjected to the decoloring process and a plurality of cassettes 20A to 20C are used to continuously operate at night when no person is present, the decoloring process is executed in order from the paper cassette 20C having the low coverage rate to the paper cassette 20A having the high coverage rate. In this case, the decoloring temperature is gradually increased. Since the heat roller 29*b* gradually accumulates heat, if the decoloring process is performed on the paper in order from the paper with low coverage rate to the paper with high coverage rate as time elapses, when the paper with high coverage rate is decolored, the heat can be sufficiently accumulated at the heat source and can be effectively used. Alternatively, the conveyance speed of the paper with the low coverage rate is fast, and the conveyance speed is slowed down as the coverage rate becomes higher. In this way, optimum performance can be obtained.

FIG. 8 is a flowchart depicting the decoloring process if there is a standby job. As shown in FIG. 8, optimum control can be selected depending on the presence or absence of the standby job. When performing a decoloring operation, if there is a next copy job or print job on standby, the set temperature is raised with the time of completion of job as the top priority to quickly perform the decoloring. If there is no standby job, the conveyance speed can be slowed down to perform the decoloring.

The controller 5 refers to the number in the number area of the processing information file of the RAM 54 to confirm whether there is a next copy job or a print job on standby (ACT 201). If there is a next job on standby (Yes in ACT 201), the controller 5 reads out the decoloring setting temperature and the conveyance speed setting value corresponding to the current coverage rate from the high speed mode area of the setting file in the HDD 55 (ACT 202). The controller 5 heats the heat roller 29*b* at the read decoloring setting temperature, controls the conveyance section 57 at the read conveyance speed setting value, and then decolors the paper (ACT 203). If there is no next job on standby (No in ACT 201), the controller 5 reads out the decoloring setting temperature and the conveyance speed setting value corresponding to the current coverage rate from the standard mode area of the setting file in the HDD 55 (ACT 204).

In some embodiments, for example, if the decoloring is performed on the paper with the coverage rate "low" in the cassette 20C in the normal mode, and there is the next job on standby, the mode is switched to the high speed mode, the decoloring betting temperature is raised from 110 degrees centigrade to 130 degrees centigrade, and the conveyance speed is increased from the first conveyance speed $V_1$ to the third conveyance speed $V_3$ to execute the decoloring. In this way, it is possible to shorten the job completion time.

In some embodiments, if there is no next job, the decoloring temperature is set according to the coverage rate through the decoloring in the standard mode, thereby reducing power consumption. If there is a next job, it is possible to shorten the job completion time, by performing the decoloring in the high speed mode.

FIG. 9 is a flowchart depicting the decoloring process in which the warm-up time is reduced. As shown in FIG. 6, in the case of an MFP in which the cassette is set for each coverage rate, while the decoloring of the paper in the cassette is consecutively executed, when the remaining amount of the paper in the cassette becomes low, the temperature required for the next cassette is changed to a preset temperature in advance, thereby enabling the quick decoloring operation.

The controller 5 detects the remaining amount of the paper in the paper feed cassette with the paper feed section sensor (ACT 301). The controller 5 determines whether the remaining amount of the paper in the paper feed cassette is equal to or less than a predetermined storage capacity with the paper feed section sensor (ACT 302). If the remaining amount of the paper is not less than the predetermined storage capacity (No in ACT 302), the controller 5 executes the decoloring process based on the current decoloring temperature setting. If the remaining amount of the paper is equal to or less than the predetermined storage capacity (Yes in ACT 302), the controller 5 determines whether there is a paper in the next cassette (ACT 304). If there is no paper in the next cassette (No in ACT 304), the controller 5 performs the decoloring process until the cassette is empty (ACT 305). If there is the paper in the next cassette (Yes in ACT 304), the controller 5 reads out the decoloring setting temperature and the conveyance speed setting value of the standard mode area corresponding to the next cassette in the setting file in the HDD 55 (ACT 306). The controller 5 heats the heat roller 29*b* at the read decoloring setting temperature, controls the conveyance section 57 at the read conveyance speed setting value to decolor the paper (ACT 307). The controller 5 switches the cassette to the next cassette if the paper in the paper feed cassette runs out (ACT 308).

In at least one embodiment, for example, if the paper in the cassette 20C is decolored, when the remaining amount of the paper in the cassette 20C becomes equal to or less than the predetermined storage capacity and there is the paper in the next cassette 20B, at this time point, the decoloring temperature setting of the next cassette 20B is read out, and the remaining paper in the cassette 20C is decolored at the set temperature of the cassette 20B. In this way, at the time of switching the cassette 20C to the cassette 20B, the temperature of the heat roller 29*b* already reaches the decoloring temperature of the paper in the cassette 20B, and thus, the warm-up time of the heat roller 29*b* can be reduced.

Although the set temperature of the heat source is changeable in the above description, the same effect can be obtained by changing the conveyance speed rather than the set temperature. For example, when the coverage rate is low, the conveyance speed is set to the high speed and the conveyance speed is slowed down as the coverage rate becomes higher. However, if the conveyance speed is slowed down unnecessarily, the next job is affected, and thus, when the next print job is on standby, the effect can be handled by setting the temperature of the heat source without slowing down the conveyance speed, and when there is no next job, the conveyance speed is slowed down.

While certain embodiments have been described, these embodiments have been presented by way of example only, and, are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A decoloring apparatus, comprising:

a decoloring assembly configured to heat an image receiving medium on which an image is formed by a decolorable color material at a predetermined set temperature;

a driver configured to drive the decoloring assembly at a predetermined conveyance speed;

a storage configured to store:

first setting information, being setting information when there is no next job, in which a set temperature of the decoloring assembly for each of plural coverage rates of the image receiving medium and a conveyance speed of the driver are associated with each other, and second setting information, being setting information when there is a next job, in which a set temperature of the decoloring assembly for each of plural coverage rates of the image receiving medium and a conveyance speed of the driver are associated with each other;

a controller configured to:

perform control to drive the decoloring assembly based on the conveyance speed and the set temperature corresponding to a predetermined coverage rate of the image receiving medium in the first setting information stored in the storage when there is no next job, or perform control to drive the decoloring assembly based on the conveyance speed and the set temperature corresponding to a predetermined coverage rate of the image receiving medium in the second setting information stored in the storage when there is a next job; and a plurality of cassettes, wherein the controller is configured to set a coverage rate of the image receiving medium stored in the cassette for each cassette and to perform control to decolor an image receiving medium from a cassette set for housing an image receiving medium with a low coverage rate, wherein each of the plurality of cassettes has a remaining amount detection sensor configured to detect a remaining amount of the image receiving medium, and when the remaining amount detection sensor detects that the remaining amount of an image receiving medium with predetermined coverage rate in a cassette accommodating the image receiving medium is equal to or less than a predetermined amount, the controller is configured to perform control to drive the decoloring assembly based on a set temperature and a conveyance speed when the coverage rate is higher than the predetermined coverage rate from the first setting information stored in the storage.

2. The decoloring apparatus according to claim 1, wherein each of the plural coverage rates of the image receiving medium in the first setting information is associated with the same conveyance speed, and as the coverage rate of the image receiving medium becomes higher, a higher set temperature is associated with the coverage rate, each of the plural coverage rates of the image receiving medium in the second setting information is associated with the same set temperature, and as the coverage rate of the image receiving medium becomes higher, a lower conveyance speed is associated with the set temperature, the set temperature associated with each of the plural coverage rates of the image receiving medium in the first setting information is equal to or less than the same set temperature in the second setting information, and the conveyance speed associated with each of the plural coverage rates of the image receiving medium in the second setting information is equal to or higher than the same conveyance speed in the first setting information.

3. The decoloring apparatus according to claim 1, further comprising:

a user interface configured to input the coverage rate of the image receiving medium for each of the cassettes.

4. The decoloring apparatus according to claim 3, further comprising:

a screen prompting a user to input the coverage rate of the image receiving medium of one of the cassettes when the one of the cassettes does not have a set coverage rate.

5. The decoloring apparatus according to claim 1, wherein the controller is configured to perform control such that a decoloring temperature is gradually increased from the cassette having a lower coverage rate to the cassette having a higher coverage rate.

* * * * *